United States Patent [19]

Ghaderi et al.

[11] Patent Number: 4,588,888

[45] Date of Patent: May 13, 1986

[54] MASS SPECTROMETER HAVING MAGNETIC TRAPPING

[75] Inventors: Sahba Ghaderi; Juda L. Shohet; Duane P. Littlejohn, all of Madison, Wis.

[73] Assignee: Nicolet Instrument Corporation, Madison, Wis.

[21] Appl. No.: 700,298

[22] Filed: Feb. 11, 1985

[51] Int. Cl.[4] ..... H01J 49/38

[52] U.S. Cl. ..... 250/291; 250/290

[58] Field of Search ..... 250/291, 290, 292

[56] References Cited

U.S. PATENT DOCUMENTS

| | | | |
|---|---|---|---|
| 3,257,579 | 6/1966 | Delcroix et al. | 250/291 |
| 3,742,212 | 6/1973 | McIver | 250/291 |
| 3,937,955 | 2/1976 | Comisarow et al. | 250/291 |

*Primary Examiner*—Alfred E. Smith
*Assistant Examiner*—Jack I. Berman
*Attorney, Agent, or Firm*—Kinney & Lange

[57] ABSTRACT

A mass spectrometer of the type wherein the sample is ionized, excited into resonance and detected within a generally homogeneous magnetic field. During detection, the magnetic field is perturbed to form magnetic mirror regions to contain the ions. Prior to detection, the ions may be contained by conventional trapping techniques or by magnetic reflection.

11 Claims, 5 Drawing Figures

MASS SPECTROMETER HAVING MAGNETIC TRAPPING

BACKGROUND OF THE INVENTION

1. Field of the Invention.

The present invention relates to mass spectrometry and, particularly, to the confinement of ions within a cell during detection.

2. Description of the Prior Art.

Ion cyclotron resonance (ICR) is a known phenomena and has been employed in the context of mass spectroscopy. Essentially, this mass spectrometer technique has involved the formation of ions and their confinement within a cell for excitation. Ion signals may then be detected for spectral evaluation. An example of such a device is disclosed in U.S. Pat. No. 3,742,212, issued June 26, 1973 which is hereby incorporated by reference.

A later development to the above incorporated patent is Fourier Transform mass spectroscopy through which rapid and accurate mass spectroscopy became possible. This technique is disclosed in U.S. Pat. No. 3,937,955 issued Feb. 10, 1976 which is commonly owned with the present invention and which is also hereby incorporated by reference.

Both of the above-referenced patents employ ion trapping while the mass analysis is performed either by the measurement of the absorption of the applied excitation radio frequency of the ions at their resonance state or by direct detection of the cyclotron frequency of the excited ions. Both require trapping of ions, after formation, in an electrostatic DC trapping cell. In such conventional systems, the ions are formed using known techniques such as electron impact, Laser desorption, Cesium ion desorption, etc. The ions thus formed undergo a circular (orbital) motion known as cyclotron motion. This motion is due to the thermal energy of the ions and the applied magnetic fields of the known devices and is restricted in the directions orthogonal to the magnetic field of those devices as a result of that magnetic field. As is known in the art, these axes are referred to as the X and Y axes. The ion motion in the Z axis (that axis parallel to the magnetic flux lines) is restricted by electrostatic potentials applied to the trapping plates. The polarity of the ions that are trapped is determined by the polarity of the DC electric potential applied to the trapping plates.

It is well known to those skilled in the art that two significant problems that interfere with exact mass measurement in mass spectrometers arise from an electrostatic inhomogeneity due to the applied DC trapping potentials as well as the fluctuations of the magnetic field. In recent years, the use of a persistent type, high field, superconductive magnet with inherent field stability has ameliorated one of these factors of uncertainty from exact mass measurement. That is, magnetic field variation has been greatly reduced, if not eliminated. The other factor, the effect of the electrostatic trapping field, remains with known prior art devices.

As is known to those familiar with the art, the presence of the DC electrostatic trapping potential affects the frequency of the ion cyclotron motion. The major effect of this field is a shift of ion cyclotron frequency. This effect is nonlinear and mass dependent. This nonlinearity has made the task of ion cyclotron frequency to ion mass conversion very complex. To this is added the uncertainty about the value of the true trapping field and its stability within the cell and the nonlinear equipotentials in a conventional cell. With conventional instruments, the frequency to mass translation is done empirically by the use of an internal or external calibrant.

SUMMARY OF THE INVENTION

The present invention employs a magnetic bottle for ion trapping which, at least during ion detection, eliminates the effect of the electrostatic trapping potential of prior art devices. The generally homogeneous magnetic field of the known mass spectrometers is perturbed to establish magnetic mirror regions which reflect the ions and contain them. Magnetic bottles are known, for containment of plasma, for example. In one embodiment, the magnetic bottle is formed by magnetic coils. In another embodiment, a high magnetic permeability material (ferromagnetic) ring or disk may be employed to establish the magnetic bottle. Multiple magnetic bottles may be created to establish multiple cells of trapped, ions.

DETAILED DESCRIPTION OF THE PREFERRED EMBODIMENTS

The reflection of a charged particle in a converging magnetic field is a known phenomena. This phenomena is commonly employed in the confinement of plasmas and also explains the Van Allen belts which surround the earth. The term "magnetic bottle" is well known to those familiar with plasma confinement while the point at which a charged particle is reflected within a converging magnetic field has been termed the "magnetic mirror region." Those terms are employed herein in the same sense as they are employed in those arts or sciences.

Figure 1:
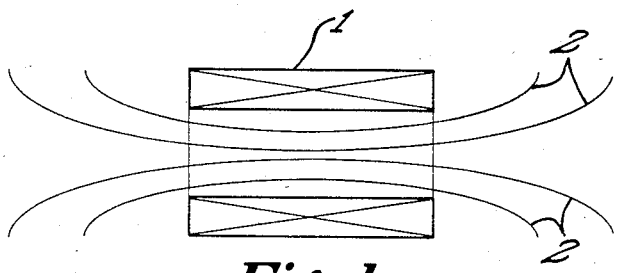
Fig 1 PRIOR ART
FIG. 1 is a schematic diagram of the magnetic field of a typical prior art mass spectrometer.
Figure 2:
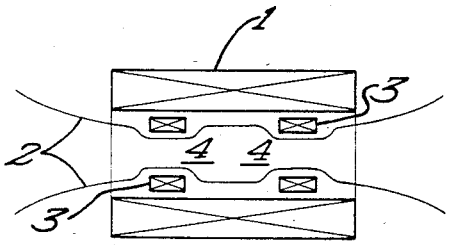
FIG. 2 is a schematic diagram of a magnetic bottle for a mass spectrometer according to the present invention.

FIG. 1 illustrates the magnetic field of a typical prior art mass spectrometer. The field is established by a coil 1 and is generally homogeneous, at least at the center of the coil 1 as illustrated by the flux lines 2. The principle of the present invention is illustrated in FIG. 2 wherein a coil 1, of the type known to the prior art, establishes a central magnetic field. However, that field is perturbed by magnetic coils 3 positioned within the core of the major coil 1 to establish a magnetic bottle, again as shown by the flux lines 2. The coils 3 have a pinching or converging effect on the field established by the coil 1 to form a magnetic bottle and establish a magnetic mirror region generally designated at 4. A charged particle within the core of the coil 1 could thus be reflected between the regions 4 while having a cyclic movement in a plane generally perpendicular to the axis of the core of the magnet 1. In this manner, the magnetic field alone can trap ions independent of the sign of their charge.

Figure 3:
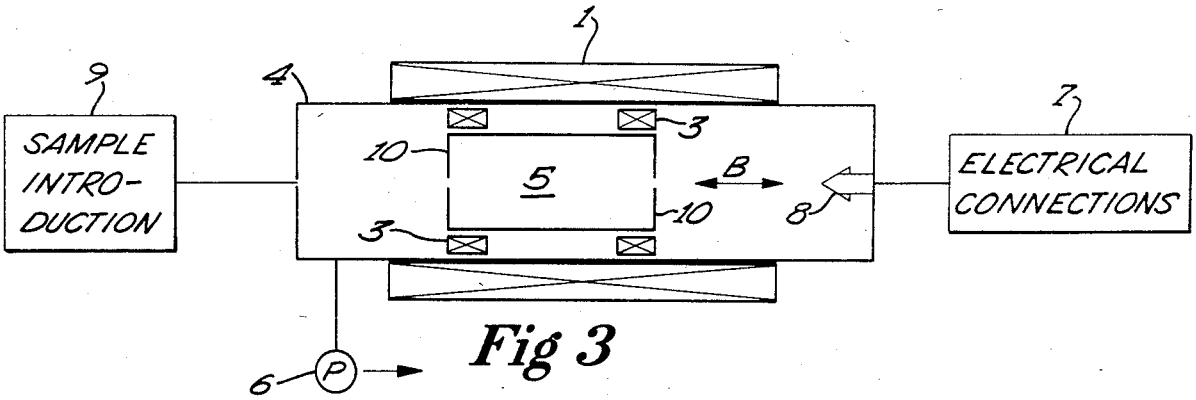
FIG. 3 is a schematic diagram of a mass spectrometer incorporating the magnetic bottle illustrated in FIG. 2.

One application of the concept of the present invention as shown in FIG. 2 is illustrated in FIG. 3. In large measure, FIG. 3 illustrates a conventional mass spectrometer having a vacuum chamber 4 which includes a trapped ion cell 5 of conventional design. Vacuum pump 6 evacuates the chamber which is surrounded by the magnet 1. The magnet 1 of FIG. 3 corresponds with the magnet 1 of FIGS. 1 and 2. Indeed, throughout the several figures, elements with like reference numerals are at least functionally identical.

A sample introduction system is illustrated at 9 and may be of any conventional design. Similarly, electrical connection 7 may be of any conventional design. Typically, the electrical connections would include an ionizing system as depicted at 8.

As is known in the art, molecules of the sample are introduced, via sample introduction system 9, pass through the chamber 4 and enter the trapping cell 5. Sample molecules within the cell 5 are ionized by any conventional means, as depicted by reference numeral 8, including electron impact, Laser desorption, Cesium ion desorption, etc. Electrical connections 7 also include connections to the various excitation, detection and trapping plates of the cell 5, described in the incorporated patents. The trapping plates are illustrated at 10 in FIG. 3.

In conventional operation, the elements of FIG. 3 described to this point go through quench, ionization and excitation stages, all in known manner. The trapping plates 10 contain the ions within the cell 5 while they undergo cyclotron motion as a result of the field established by the coil 1. In a typical prior art device, ion cyclotron motion would then be detected, in known manner. However, in the present invention, additional coils 3 are positioned within the chamber 4 as described with reference to FIG. 2 to perturb the magnetic field set up by the coil 1. In the practice of the present invention, after ionization, excitation but before detection, the trapping potential on the plates 10 is removed to eliminate their effect on the detection process. The ions within the cell 5 are contained within a magnetic bottle and move between magnetic mirror regions established within the cell by the coils 3. Ion detection may then be accomplished in the usual manner.

Figure 4:
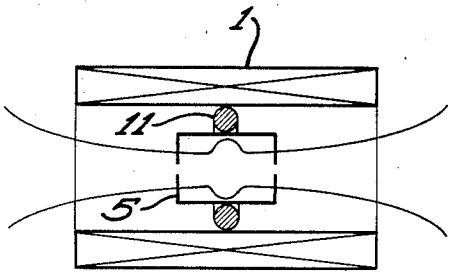
FIG. 4 is a schematic diagram of an alternate embodiment of a magnetic bottle for a mass spectrometer according to the present invention.
Figure 5:
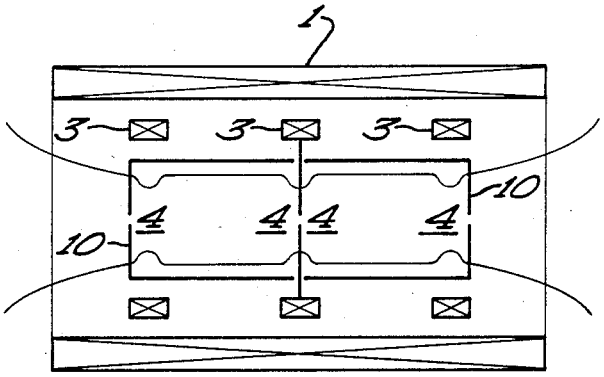
FIG. 5 is a schematic diagram of an alternate embodiment of a magnetic bottle for a mass spectrometer according to the present invention.

Obviously, many modifications and variations of the present invention are possible in light of the above teachings. For example, magnetic trapping in accordance with the present invention will not usually affect unexcited ions. This is due to the fact that trapping by magnetic perturbation depends on the pitch angle of the ions (angle of the velocity vector with respect to the DC magnetic field). The pitch angle is required to be above a value which is determined by the ratio of the maximum to the minimum value of the magnetic field in the bottle region in order for trapping to occur. It is independent of the mass and sign of the charge of the ion. Thus, both positively and negatively charged ions may be trapped in the same configuration at the same time. However, this requires that the trapping plates 10 in FIG. 3 not be employed and that the trapping be accomplished totally by perturbation of the magnetic field. This is within the scope of the present invention. Also within the scope of the present invention is the creation of the magnetic perturbation within the field established by the coil 1 as by a ferromagnetic ring or disk 11 placed around the center of the cell 5 as illustrated in FIG. 4. It is also within the contemplation of the present invention that multiple magnetic bottles be established through the use of three or more coils or ferromagnetic rings, discs or other devices as illustrated in FIG. 5. It is therefore to be understood that, within the scope of the appended claims, the invention may be practiced otherwise than as specifically described.

What is claimed is:

1. In a mass spectrometer of the type wherein a sample is ionized, excited into resonance and detected, the improvement comprising magnetic bottle means for trapping the ions.

2. The mass spectrometer of claim 1 further comprising electrostatic trapping means.

3. In a mass spectrometer of the type having vacuum chamber means, means for introducing a sample into said chamber means, means for ionizing a sample within said chamber means, means producing a generally homogeneous magnetic field within said chamber means for inducing ion cyclotron resonance, trapping means for restricting ion movement along said magnetic field, means for exciting ions restricted by said trapping means and means for detecting ion excitation, the improvement wherein said trapping means comprises means perturbing said magnetic field and establishing magnetic mirror regions within said chamber for reflecting said ions.

4. The mass spectrometer of claim 3 wherein said means perturbing said magnetic field comprises magnetic coil means.

5. The mass spectrometer of claim 4 wherein said magnetic coil means comprises at least three magnetic coils.

6. The mass spectrometer of claim 3 wherein said means perturbing said magnetic field comprises high magnetic permeability (ferromagnetic) means encircling said chamber means.

7. The mass spectrometer of claim 6 wherein said perturbing means comprises at least two means encircling said chamber means.

8. The mass spectrometer of claim 3 wherein said trapping means further comprises electrostatic trapping means.

9. The mass spectrometer of claim 3 wherein said trapping means further comprises trapping plate means.

10. The method of mass spectroscopy comprising the steps of:

introducing a sample into a vacuum chamber;
producing a generally homogeneous magnetic field within said vacuum chamber;
ionizing the sample within said vacuum chamber;
exciting at least some of the ions produced within said vacuum chamber;
detecting ion excitation; and
magnetically restricting ion movement within said vacuum chamber at least during said detecting step.

11. The method of mass spectroscopy of claim 10 further comprising the step of electrostatically restricting ion movement within said vacuum chamber prior to said detecting step.

* * * * *